United States Patent [19]

Zahn et al.

[11] 4,142,876

[45] Mar. 6, 1979

[54] RECOVERY OF NATURAL GAS LIQUIDS BY PARTIAL CONDENSATION

[75] Inventors: Carl W. Zahn, Stavanger, Norway; Hadwen A. Clayton, Bartlesville, Okla.

[73] Assignee: Phillips Petroleum Company, Bartlesville, Okla.

[21] Appl. No.: 792,365

[22] Filed: Apr. 29, 1977

Related U.S. Application Data

[62] Division of Ser. No. 579,993, May 22, 1975, Pat. No. 4,040,259, which is a division of Ser. No. 315,535, Dec. 15, 1972, Pat. No. 3,901,673.

[51] Int. Cl.[2] ..... F25J 3/00

[52] U.S. Cl. ..... 62/37; 62/21; 62/23; 196/132

[58] Field of Search ..... 62/21, 37; 196/132

[56] References Cited

U.S. PATENT DOCUMENTS 3,901,673 8/1975 Zahn et al. ..... 62/21

4,040,259 8/1977 Zahn et al. ..... 62/37

*Primary Examiner*—Norman Yudkoff

[57] ABSTRACT

In the recovery of natural gas liquids by partial condensation, flashing, and compression, minimum and maximum temperature control of partially condensed feed stream hydrocarbons to a product separator is imposed by a minimum temperature control system which provides the same set point to the pressure controllers on the compressor suction scrubbers for both the product and the flashed vapor produced from the liquid outlet of the product separator with one of the two output signals responsive to the pressure of the product suction scrubber or the flashed vapor suction scrubber manipulating, by way of a selective relay, the engine speed controller of the dual compressor unit taking suction from the two scrubbers; and a maximum temperature controller which controls the rate of by-pass of natural gas feed around the partial condensation-separation system unless, by means of a selective relay, compressor availability is a more limiting criterion.

4 Claims, 1 Drawing Figure

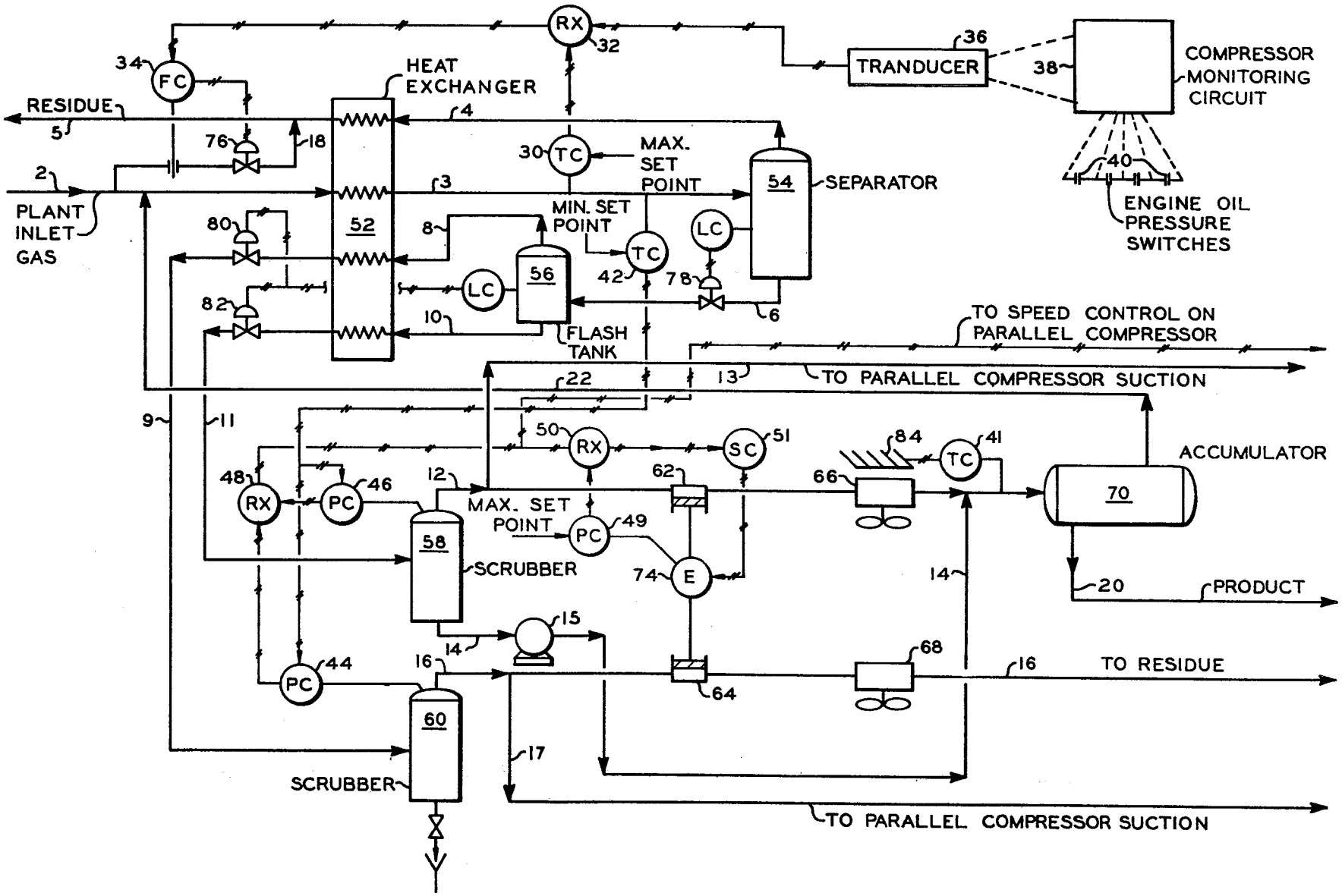
COMPRESSOR MONITORING CIRCUIT
ENGINE OIL PRESSURE SWITCHES
TRANDUCER
SEPARATOR
TO SPEED CONTROL ON PARALLEL COMPRESSOR
TO PARALLEL COMPRESSOR SUCTION
ACCUMULATOR
PRODUCT
TO RESIDUE
TO PARALLEL COMPRESSOR SUCTION
MAX. SET POINT
MIN. SET POINT
FLASH TANK
HEAT EXCHANGER
MAX. SET POINT
SCRUBBER
SCRUBBER
RESIDUE
PLANT INLET GAS

RECOVERY OF NATURAL GAS LIQUIDS BY PARTIAL CONDENSATION

This is a divisional application of copending application having Ser. No. 579,993, filed on May 22, 1975, now U.S. Pat. No. 4,040,259, which is a divisional application of Ser. No. 315,535, filed on Dec. 15, 1972, now U.S. Pat. No. 3,901,673.

BACKGROUND OF THE INVENTION

This invention relates to a method and apparatus for recovery of natural gas liquids. In one aspect the invention relates to a method and apparatus for the recovery of natural gas liquids by partial condensation, flashing, and compression. In another aspect of the invention it relates to a control system to be utilized in the recovery of natural gas liquids by partial condensation, flashing and compression. In a further aspect of the invention it relates to a method and apparatus for controlling minimum and maximum temperature of partially condensed feed hydrocarbons to a natural gas liquid recovery system.

Condensable hydrocarbons are valuable products contained in natural gas. Refrigerating natural gas to recover a maximum of readily condensable hydrocarbons from the gas is an established practice in the industry. The most economical operation of such a process involves continuous unattended operation. The recovery of natural gas liquids involves partial condensation, flashing, and compression of flashed vapor. To assure continuous unattended operation of such a process it is necessary to have a control system which can accommodate not only minor variations in feed gas volume and composition but also serious disturbances such as mechanical malfunction of compressing means.

Accordingly, it is an object of this invention to provide an improved control system for regulating the temperature of the feed stream to a separating means in a partial condensation natural gas liquid recovery system. It is another object of this invention to provide a method and apparatus for the recovery of natural gas liquids. It is still another object of this invention to provide economical method and apparatus for recovering heavy hydrocarbons from natural gas containing the same. It is a further object of this invention to provide method and apparatus for the separation of natural gas liquids from natural gas without requiring external refrigeration. It is another object of this invention to provide method and apparatus for controlling the process of separating natural gas liquids from a natural gas mixture. It is a further object of this invention to provide method and apparatus for bypassing flow around a condensation, condensate flashing, and flashed vapor compression system, determining bypass volume in view of compression means availability.

Other aspects, objects and advantages of this invention will be apparent from a study of the disclosure, the drawing and the appended claims to the invention.

STATEMENT OF THE INVENTION

In accordance with the present invention, in a system for the recovery of natural gas liquids by partial condensation a method and apparatus for controlling the minimum temperature of the partially condensed inlet feed stream to a separator is provided with comprises: allowing inlet material that has been partially condensed by passage through a heat exchanger to separate in a separation means to produce a vapor outlet stream and a liquid outlet stream; separately passing the vapor outlet stream from the separating means in heat exchange with inlet gas to the separating means; flashing at least a portion of the liquid outlet stream from the separating means in a flash tank with both the flash tank vapor outlet and the flash tank liquid outlet separately passing from the flash tank in heat exchange with the inlet material to the separating means; and separately passing both the heat exchanged flash tank vapor and flash tank liquid to separate, pressure controlled scrubber tanks wherein the pressure is controlled by drawing vapor from the scrubber tanks to the suctions of compression means; and controlling the suction pressures to the compression means by: producing a control signal responsive to the temperature of the separator inlet material; transmitting this control signal as the set point for the pressure controllers for both scrubber tanks; generating output signals responsive to the pressures of both of the scrubber tanks and the set point; selecting in a first selector relay the control signal produced from the higher scrubber pressure and transmitting this signal as set point for the speed controller operably associated with compressor drive means. If desired, this first selected signal may be transmitted to a second selector relay which selects between this signal and a control signal responsive to the power consumption of the compression drive means and this second selected signal transmitted to the speed controller of the compression drive means and transmitting this signal as the set point to a speed controller operably associated with the compressor drive means thereby manipulating the capacity thereof and indirectly manipulating the plant inlet gas flow rate through the inlet heat exchanger.

In an embodiment of the invention a method and apparatus for controlling the maximum temperature of at least partially condensed inlet feed stream to a separator are provided comprising separating the condensate, flashing and heat exchanging the inlet stream followed by separately passing both the heat exchanged flash tank vapor and flash tank liquid to separate pressure controlled scrubber tanks as described above, wherein the pressure of the tanks is controlled by drawing vapor from the scrubber tanks to the suction of compression means, the additional steps of generating a signal corresponding to the temperature of the inlet at the separator and transmitting this signal to actuate a flow control means for bypass of inlet gas from the inlet of the heat exchange means to a residue outlet means from the partial condensation system thereby bypassing the partial condensation system with at least a portion of the inlet gas.

In another embodiment of the invention a method for controlling the bypass of inlet gas around a compressor system utilizing a plurality of compressors in parallel operation is provided which comprises: sensing the compressor operating status of each compressor from the oil pressure of each compressor; generating an operational status signal when a compressor is operating to operate relay means with contacts which change the current input to a pneumatic transducer; generating a signal in the transducer which corresponds to the summation of signals from the compressors; and transmitting the transducer signal to operate a flow control means to bypass at least a portion of inlet gas around the partial condensation system in an inverse proportion to the proportion of compressors in operation as compared to the total number of compressors in the system.

In yet another embodiment of the invention, a method and apparatus are provided by which the signal from the transducer, as described above, actuates a flow control means which bypasses inlet gas around the partial condensation system so that the amount of gas flowing into the partial condensation system is in proportion to the compression capacity available at a given time, and the signal corresponding to the temperature of the inlet to the separator actuates the bypass flow control means within the range of bypass remaining, up to a total bypass of inlet.

The apparatus and method of this invention can be used in separating petroleum gas liquid from any petroleum gas which contains condensable materials. Generally, liquids are condensed from field streams which flow within a constant range. Liquids condensed from the inlet stream will generally have a vaporization tempeature in the range of −50° to about −80° F. The noncondensable material is passed on to be used as fuel gas or to have lower boiling constituents removed in other equipment. The removal of liquids boiling at −65° F. and above facilitates the subsequent handling of material that is not condensed at this temperature.

The apparatus of this invention and the method of this invention for operating the apparatus can best be understood in conjunction with the drawing which is a diagrammatic representation of the controlled flow of material through the partial condensation, flashing, and subsequent compression of a field feed gas to produce a condensed liquid product and separated residue gas. In the drawing, a relatively constant supply of inlet gas containing hydrocarbons having a boiling point above −65° F. is introduced into line 2 at an ambient temperature which can range up to about 85° F. but is preferably described as being about 70° F. and in a pressure range of about 500–600 psig. The plant inlet gas at about 500 psig is passed by line 2 into the heat exchanger 52 where its temperature is dropped to within the range of −60° to −70° F., preferably about −65° F. This heat exchanged material, which is now partially condensed, is passed by line 3 to a separator 54 from which noncondensed vaporous material flows through line 4 and heat exchanger 52 where, in heat exchange with the inlet gas, it is warmed back to ambient temperature and leaves the system as residue gas by line 5. The liquid from the separator 54 is discharged through line 6 and a control valve 78 into flash tank 56 at a reduced pressure of about 30 psig. This reduction of pressure considerably reduces the temperature of the liquid due to partial vaporization in flash tank 56.

Vapor from the flash tank 56 is passed by line 8 through the heat exchanger 52 in heat exchange with the inlet gas and by line 9 through control valve 80 into vapor scrubber 60. In scrubber 60 any entrained liquid is removed from the system through the scrubber base and the vapor, having been warmed to ambient temperature by heat exchange with the inlet gas, is passed through line 16 to compression means 64 and from there to be joined with the residue gas with cooling by air fin cooler 68 as desired. Parallel compressors may receive gas by line 17 as desired.

The liquid from flash tank 56 is passed by line 10 to the heat exchanger 52, in heat exchange with the inlet gas, through control valve 82 and on to liquid product scrubber 58 by line 11. In the liquid product scrubber 58 the material, which is by then warmed to near ambient temperature by heat exchange with the inlet gas, is separated into liquid and vapor phases. The vapor phase is withdrawn through line 12 by compression means 62 and by line 13 to parallel compression means as described where the pressure is increased to a pressure in the range of 500–600 psig and passed to a product accumulator tank 70 through air fin condenser 66. The liquid from scrubber 58 is pumped through line 14 by pump 15 to the product accumulator tank 70. The liquid product can be removed from the accumulator tank through line 20 and vapor can be removed from the product accumulator tank by line 22 and thence to inlet gas line 2 for recirculation as desired.

The key to the successful operation of this system is control of the inlet temperature to the initial product separator within a specified range so that the desired separation can be made between condensed liquid product and residual gases. Although the separation of materials has been presented with a separation temperature of −65° F., it must be borne in mind that other combinations of separator inlet pressure and controlled temperatures can be used with the apparatus and method of this invention particularly in view of differing natural gas compositions. To accomplish this broad objective, a novel combination of a minimum temperature control system with a maximum temperature control system has been developed.

Referring now to the drawing for discussion of the operation of the novel systems for the control of the inlet temperature to the separator, a measurement of the inlet temperature to separator 54 is transmitted to temperature controller 42, wherein it is compared with a minimum temperature set point signal and a control signal is produced from this comparison. The control signal is transmitted as the set point to both pressure controllers 44 and 46. Pressure controllers 44 and 46 each generate a signal responsive to the comparison of this set point with the measured pressure within each of the respective scrubbers. These pressure control signals are transmitted to selector relay 48 which transmits the control signal produced from the higher scrubber pressure (the larger of the two signals) to the speed controller 51 via selector relay 50 (to be described below) which governs the level of operation of compressor driving engine 74 which in turn governs the compression capacity of both compressors 62 and 64 respectively on line 12 (liquid product flash scrubber gas) and line 16 (low temperature flashed gas to residue) both originating from product flash tank 56. In the above described manner, the dual compressor is called upon to draw a controlled volume of gas into its suction thus controlling the balancing of the flow of low temperature gas and liquid through heat exchanger 52 from flash tank 56. In this manner a greater or lesser degree of heat exchange with the plant inlet gas is employed to control the temperature of the heat exchanged, partially-condensed feed material to the initial separator 54.

To control the maximum temperature of the partially-condensed feed to the initial separator, a temperature controller 30 receives a measurement signal of the inlet temperature of material to separator 54. This signal is compared with the maximum temperature set point to controller 30 and a control signal is produced responsive to this comparison. This control signal is transmitted to selector relay 32 wherein the larger of this signal or that received from transducer 36 (described below) is transmitted to bypass flow controller 34 as the set point thereto. Controller 34 manipulates valve 76 in bypass line 18 to reduce the flow of plant inlet gas by passing the nonprocessable gas directly to the residue gas if limiting plant capacity conditions are encountered in terms of maximum temperature of initial separator feed or compressor availability signaled by transducer 36 as further described below. Reducing the volume of plant inlet gas flowing at ambient temperature into the heat exchanger 52 directly reduces the temperature of the partially-condensed stream in line 3.

Recovery of natural gas liquids as proposed is intended for use with a compressor system utilizing a plurality of compressors in parallel operation. To control the minimum temperature of the system, each of the parallel operating compressors would be equipped with its own intake manifold pressure sensing and control device 49 which would generate and transmit a control signal corresponding to a comparison of the intake manifold pressure with a maximum set point value thereof to a selector relay 50 which corresponds to a selector relay 48. Selector relay 48 would send a parallel signal to the individual selector relay for each compressor corresponding to selector relay 50. These individual selector relays would then choose the lower of the two control signals from relay 48 and from individual manifold pressure controller 49 for that compressor and transmit it to speed controller 51 for the individual compressor.

Provision has also been made for bypassing plant inlet gas around the heat exchanger 52 depending on the availability of compression capacity. Each compressor is equipped with an operating status sensor which senses from the lubricating oil pressure (or other conditions) of the individual compressor whether or not the compressor is running. These engine oil pressure switches 40 each generate a signal which operates a relay means 38 with a contact which changes the current input to a current-to-pneumatic transducer 36. The transducer 36 generates a signal which corresponds to the summation of the signals from the compressor engine oil pressure switches 40, thus transmitting a control signal corresponding to the total number of compressors running. The signal from transducer 36 is then transmitted to alternatively operate flow controller 34 to bypass inlet gas from line 2 through a flow control means 76 and line 18 to the residue gas line 5 as the controller functions in a manner to bypass the inlet gas in an inverse relationship to the number of compressors in operation as compared to the total number of compressors in the system. For example, if four compressors are provided, three of which are in operation with one shut down, the signal from transducer 36 will be of the magnitude corresponding to one fourth of the flow scale of controller 34 and if applied as the set point thereto by the action of selector relay 32, will result in the bypassing of one fourth of the plant inlet gas stream to the residue gas stream 5, thus feeding three fourths of the available natural gas to the liquid recovery plant. Thus this system provides alternative control of the maximum temperature to the separator 54 for unattended operation, the signal from transducer 36 and the signal from temperature controller 30 both being transmitted to selector relay 32 which transmits the larger signal to flow controller 34.

Reasonable variation and modification are possible within the scope of the foregoing disclosure, the drawing and the appended claims of this invention.

The measuring, controlling and relaying devices described herein are available from a number of manufacturers of control system components and may be of the pneumatic or electrical analog type and/or the methods and apparatus of Direct Digital Control known to those skilled in this art may be employed as desired.

We claim:

1. An apparatus for controlling the minimum temperature of an inlet feed stream to a separator in a system for the recovery of natural gas liquid by partial condensation of said inlet feed stream, said apparatus comprising:

(1) means for partially condensing an inlet feed stream material;

(2) connected to said condensation means a means for allowing the separating of partially condensed inlet feed stream material into a vapor outlet stream and a liquid outlet stream;

(3) means for passing the vapor outlet from said separating means in heat exchange with said inlet feed stream material;

(4) means for flashing the heat exchanged liquid outlet from said separating means;

(5) means for separately passing vapor outlet from said flashing means and liquid outlet from said flashing means in heat exchange with said inlet feed stream material;

(6) means for separately passing both the heat exchange vapor and liquid from the flashing means to separate pressure controlled scrubbing means;

(7) means for controlling the pressure in said scrubbing means by drawing vapor from the scrubbing means to the suction of a compression means;

(8) means for sensing the temperature of inlet flow to the separating means and producing a signal in response to said temperature;

(9) means for transmitting said signal as set point for the means of controlling the pressure of each of the scrubbing means;

(10) means for producing a signal in response to the pressure of each of the scrubbing means; and

(11) a first means for selecting the signal produced in response to the higher pressure of said scrubbing means and transmitting this signal to a separate controller as set point for drive of said compression means.

2. An apparatus for controlling the minimum temperature of an inlet feed stream to a separator in a system for the recovery of natural gas liquid by partial condensation of said inlet feed stream according to claim 1 which further comprises:

(12) transmitting to a second selecting means the signal selected by said first means for selecting the signal produced in response to the higher pressure of said scrubbing means;

(13) means for producing a signal in response to the intake manifold pressure of said compression means and transmitting the signal responsive to the intake manifold pressure to said second signal selecting means;

(14) means for selecting the lower control signal from between the signal responsive to the intake manifold pressure and the signal responsive to the scrubber pressure generated by said first relay means; and

(15) means for transmitting the signal selected by said second signal selector to a separate controller as set point for drive of said compression means.

3. An apparatus for controlling the maximum temperature of a feed stream to a separating means in a system for the recovery of natural gas liquid by partial condensation, said apparatus comprising:

(1) means for partially condensing an inlet feed stream material;

(2) connected to said condensation means a means for separating partially condensed inlet feed stream material into a vapor outlet stream and a liquid outlet stream;

(3) means for passing the vapor outlet from said separating means in heat exchange with said inlet material;

(4) means for flashing the heat exchanged liquid outlet from said separating means;

(5) means for separately passing vapor outlet from said flashing means and liquid outlet from said flashing means in heat exchange with said inlet feed stream material;

(6) means for separately passing both the heat exchange vapor and liquid from the flashing means to separate pressure controlled scrubbing means;

(7) means for controlling the pressure in said scrubbing means by drawing vapor from the scrubbing means to the suction of a compression means;

(8) means for generating a signal produced in response to the temperature of said separating means inlet material after heat exchange;

(9) a means for transmitting said signal to a means for bypassing inlet gas from said system; and

(10) means for bypassing inlet gas from said system.

4. The apparatus of claim 1 wherein said compression means is a plurality of compressors in parallel operation and means for transmitting the signal selected by the second signal selector to a plurality of compression drive controllers are provided.

* * * * *